US005265396A

United States Patent [19]

Amimoto

[11] Patent Number: 5,265,396

[45] Date of Patent: Nov. 30, 1993

[54] CONSTRUCTION METHOD OF BOARDLIKE BUILDING ELEMENTS

[75] Inventor: Koji Amimoto, Aichi, Japan

[73] Assignee: Inax Corporation, Aichi, Japan

[21] Appl. No.: 775,574

[22] Filed: Oct. 15, 1991

[30] Foreign Application Priority Data

Oct. 26, 1990 [JP] Japan ..... 2-290546
Nov. 28, 1990 [JP] Japan ..... 2-328154

[51] Int. Cl.[5] ..... E04B 1/38

[52] U.S. Cl. ..... 52/745.12; 52/511; 52/235; 52/509; 52/731.5

[58] Field of Search ..... 52/741, 745, 508, 511, 52/512, 513, 235, 732, 509, 585, 586, 713

[56] References Cited

U.S. PATENT DOCUMENTS

| | | | |
|---|---|---|---|
| 2,379,269 | 6/1945 | Barrows | 52/512 |
| 2,860,504 | 11/1958 | Sinner et al. | 52/509 |
| 3,342,005 | 9/1967 | Rickards et al. | 52/509 |
| 3,350,830 | 11/1967 | Smith, Jr. et al. | 52/513 |
| 3,478,480 | 11/1969 | Swenson | 52/235 |
| 3,888,055 | 6/1975 | Gallo | 52/585 X |
| 4,107,887 | 8/1978 | Wendt | 52/512 X |

FOREIGN PATENT DOCUMENTS

| | | | |
|---|---|---|---|
| 717919 | 12/1968 | Belgium . | |
| 2635611 | 9/1978 | Fed. Rep. of Germany | 52/513 |
| 3442183 | 5/1986 | Fed. Rep. of Germany . | |
| 2597138 | 10/1987 | France . | |

*Primary Examiner*—Carl D. Friedman
*Assistant Examiner*—Kien Nguyen
*Attorney, Agent, or Firm*—Kanesaka and Takeuchi

[57] ABSTRACT

In a construction method of boardlike building elements each having a groove formed in its upper edge face in the lengthwise direction thereof, the boardlike building elements are fixed to the wall surface of a building body in arranged form by fixing each first fixture to the building body such that the horizontal segment of each first fixture extends perpendicularly to the wall surface, inserting each second straight fixture in the downward direction in a slit which is formed in a distal edge portion of the horizontal segment of each first fixture in parallel to the wall surface, and fitting the lower edge of each second fixture in the upper edge groove of each boardlike building element, whereby the upper portion of each boardlike building element is fixed to the building body.

12 Claims, 10 Drawing Sheets

CONSTRUCTION METHOD OF BOARDLIKE BUILDING ELEMENTS

FIELD OF THE INVENTION

This invention relates to a method of securing boardlike building elements, such as tiles, stones or slabs and glass panels, to a building body surface by the use of fixtures, and more particularly, to a dry-type construction method of fixing boardlike building elements, such as large-size tiles, to the wall surface of a building body in arranged form.

RELATED ART

Conventionally, boardlike building elements, such as stones and tiles, are fixed by the use of dowel pins. For example, each stone is secured by forming dowel holes in the upper and lower edge faces of the stone, inserting dowel pins in the dowel holes, and fixing the dowel pins to a building body by the use of hooks or the like. On the other hand, where tiles are used as the wall element, they are secured by attaching a board to the back side of each tile, forming dowel holes in each board, and fixing each tile to the building body by the use of proper fixtures.

FIG. 7 shows a conventional construction method as described above. In this drawing, a building body 10 is provided with an anchor bolt 12 to which an L-shaped support fixture (L-shaped fixture) 14 is secured by a nut 12*a*. A straight fixture 20B is secured to the L-shaped fixture 14 in a horizontal position by a square-necked bolt 16 and a nut 18, and a boardlike building element 24B, is fixed to the building body 10 by a dowel pin 22 inserted in a dowel pin hole formed in the straight fixture 20B. Specifically, dowel holes 26 are formed in the upper and lower edge faces of each boardlike building element 24B, and the upper and lower ends of each dowel pin 22 are fitted in the dowel holes 26 of the adjacent building elements.

As will be appreciated, in the conventional construction method, the dowel pins 22 cannot be fitted in the dowel holes unless they are accurately aligned with each other. Where the dowel hole is made in the form of a groove, the dowel pin can readily be fitted in such a groove; however, the dowel pin tends to incline, with the result that the support of the boardlike building element 24B becomes unstable.

Further, after the boardlike building element is clamped by the dowel pin, a stress in a direction perpendicular to the building body surface (i.e. the tile surface) is applied by the dowel pin 22 to the dowel hole 26 in concentrated form, with the result that a marginal portion of the dowel hole 26 tends to be broken.

As described above, the conventional construction method, as implemented in arranging large-size tile boards or the like along the wall surface of a building body, comprises the steps of forming dowel holes in the upper and lower edge faces of each tile board, fitting dowel pins in the dowel holes, coupling hooks to the dowel pins, and fixing the tile boards to the building body. Therefore, when the dowel hole and the dowel pin are not accurately aligned with each other, the dowel pin cannot be fitted in the dowel hole, this thus making the execution of works difficult. Further, if a pressure of wind, impact, etc. is applied to the surface of the tile after the completion of construction, the resulting stress is concentrated in the marginal portion of the dowel hole, with the result that the dowel hole and its vicinity are broken.

OBJECT AND SUMMARY OF THE INVENTION

It is a first object of the present invention to provide a construction method by which boardlike building elements can very readily be attached to a building body in a short time.

It is a second object of the present invention to provide a construction method by which after the surfaces of boardlike building elements are made flush, the lower edge of each fixture can very readily be fitted in a groove formed in the upper edge face of each boardlike building element.

It is a third object of the present invention to provide a construction method in which the contact area between each boardlike building element and each fixture is made large so that even if a large external force is applied to the boardlike building element, the boardlike building element can be secured very stably without the clamped portion of the boardlike building element being broken.

It is a fourth object of the present invention to provide a construction method in which even after each fixture is fitted in a groove formed in the upper edge face of each boardlike building element, the position of each boardlike building element can be fine-adjusted by sliding it in relation to a building body surface.

It is a fifth object of the present invention to provide a construction method in which the position and direction of each fixture are made fine-adjustable so that each fixture can be reliably fitted in a groove formed in the upper edge face of each boardlike building element and the surfaces of all boardlike building elements can be made flush with each other very precisely.

It is a sixth object of the present invention to provide a construction method by which each boardlike building element can be supported without looseness.

To accomplish the foregoing objects, according to a first feature of the present invention, a construction method of fixing boardlike building elements to the wall surface of a building body in arranged form by the use of fixtures, each boardlike building element having a groove formed in the upper edge face thereof in the lengthwise direction thereof, comprises the steps of fixing a first fixture to the building body such that a horizontal segment of the first fixture extends so as to depart from the wall surface, fitting a second straight fixture in the downward direction in a slit formed in a distal edge portion of the horizontal segment of the first fixture, the slit extending parallel to the wall surface, and inserting the lower edge of the second fixture in the upper edge groove of the boardlike building element, whereby the upper portion of the boardlike building element is fixed to the building body.

That is, to implement the construction method of the first feature, it requires to arrange and hold the boardlike building elements along the building body by hands or the like, insert the second fixture in the slit of the first fixture in the downward direction, and insert the lower edge of the second fixture in the upper edge groove of the board-like building element. Since the groove is formed in the upper edge face, in the lengthwise direction thereof, of the boardlike building element, the lower edge of the second fixture can be fitted in the groove after the surface of the boardlike building element is made flush with the others. Further, since the second fixture is straight, if an external force is applied to the boardlike building element in a direction perpendicular to the surface thereof, the resulting stress is distributed over a large portion of the boardlike building element; as a result, the boardlike building element is prevented from being broken even at its edges and can be stably supported.

According to a second feature based on the first feature, a construction method is characterized in that the boardlike building element has a groove formed in the lower edge face thereof in the lengthwise direction thereof, and an upper portion of the second fixture is inserted in the lower edge groove, whereby the lower portion of the boardlike building element is fixed to the building body.

That is, to implement the construction method of the second feature, it requires to fit the lower edge groove of the boardlike building element over the second fixture in the downward direction. Therefore, even after the boardlike building element is supported by the second fixture, the position of the boardlike building element can be fine-adjusted by sliding it in relation to the building body surface (horizontally and laterally).

According to a third feature based on the first feature, a construction method is characterized in that the first fixture is composed of an L-shaped fixture having a vertical segment to be fixed to the building body and a horizontal segment extending horizontally from the vertical segment, and a straight fixture to be secured to the horizontal segment of the L-shaped fixture by a bolt; the horizontal segment and the straight fixture are formed with individual slots which extend so as to cross each other and in which the bolt is inserted; and the slit is formed in the straight fixture.

That is, in the construction method of the third feature, since the slots are formed in the horizontal segment and the L-shaped fixture so as to orthogonally cross each other, the position of the straight fixture can be fine-adjusted by loosening the bolt inserted in the slots. Further, since the direction in the horizontal plane of the straight fixture can be changed by loosening the bolt, the direction of the straight fixture can be fine-adjusted such that the slit formed in the distal edge portion of the straight fixture becomes strictly parallel to the building body surface.

According to a fourth feature based on the third feature, a construction method is characterized in that the straight fixture is formed with slits which extend from either side edge thereof; the second fixture has leg segments extending along either vertical edge thereof which are to be inserted in the slits; the width of each leg segment is larger than that of the slit; a spacer made of synthetic resin is attached to a portion, projecting from the slit, of each leg segment; and each leg segment together with the spacer is inserted in the upper edge groove of the boardlike building element.

That is, in the construction method of the fourth feature, since the spacer is attached to a lower portion of the leg segment of the second fixture, the leg segment is closely fitted in the upper edge groove of the boardlike building element by inserting the lower edge of the leg segment in the groove; therefore, the boardlike building element can be supported without looseness.

According to a fifth feature, a construction method of fixing boardlike building elements to the wall surface of a building body in arranged form by the use of fixtures, each boardlike building element having grooves formed in the upper and lower edge faces thereof in the lengthwise direction thereof; and each fixture being composed of an L-shaped fixture to be fixed to the wall surface, a straight fixture to be coupled to the L-shaped fixture as to project horizontally therefrom which has first and second slits formed in a distal edge portion thereof in parallel to the wall surface, and first and second insert plates to be inserted in the first and second slits, respectively, of the straight fixture in the downward direction; comprises the steps of inserting the first insert plate in the first slit after the straight fixture is coupled to the L-shaped fixture, fitting a lower edge portion of the first insert plate in the upper edge groove of the boardlike building element arranged on the lower side, fitting an upper edge portion of the first insert plate in the lower edge groove of the boardlike building element arranged on the upper side, whereby the boardlike building elements vertically arranged are fixed to the wall surface, and inserting the second insert plate in the second slit, whereby the boardlike building element is prevented from shifting toward the wall surface.

That is, to implement the construction method of the fifth feature, use it requires to the L-shaped fixture, the straight fixture, and the first and second insert plates, couple the straight fixture in a horizontal and projecting position to the L-shaped fixture which has been fixed to the wall surface, insert the first and second insert plates in the first and second slits formed in the distal edge portion of the straight fixture, insert the upper edge of the first (outer) insert plate in the lower edge groove of the boardlike building element arranged on the upper side, and insert the lower edge of the first insert plate in the upper edge groove of the boardlike building element arranged on the lower side, whereby the two boardlike building elements vertically arranged are fixed at their respective upper and lower edges to the wall surface by means of the first (outer) insert plate. In the thus attained state, since the second (inner) insert plate inserted in the slit is positioned on the back side of the boardlike building element, the boardlike building element is prevented from shifting toward the wall surface; therefore, even if a pushing force of wind, impact, etc. is applied to the front side of the boardlike building element after the completion of construction, the boardlike building element cannot shift toward the wall surface, the resulting stress cannot be applied to the groove of the boardlike building element in concentrated form, and thus, a satisfactory strength of installation is ensured.

DESCRIPTION OF THE PREFERRED EMBODIMENTS

Embodiments of the present invention will now be described with reference to the drawings.

Figure 1:
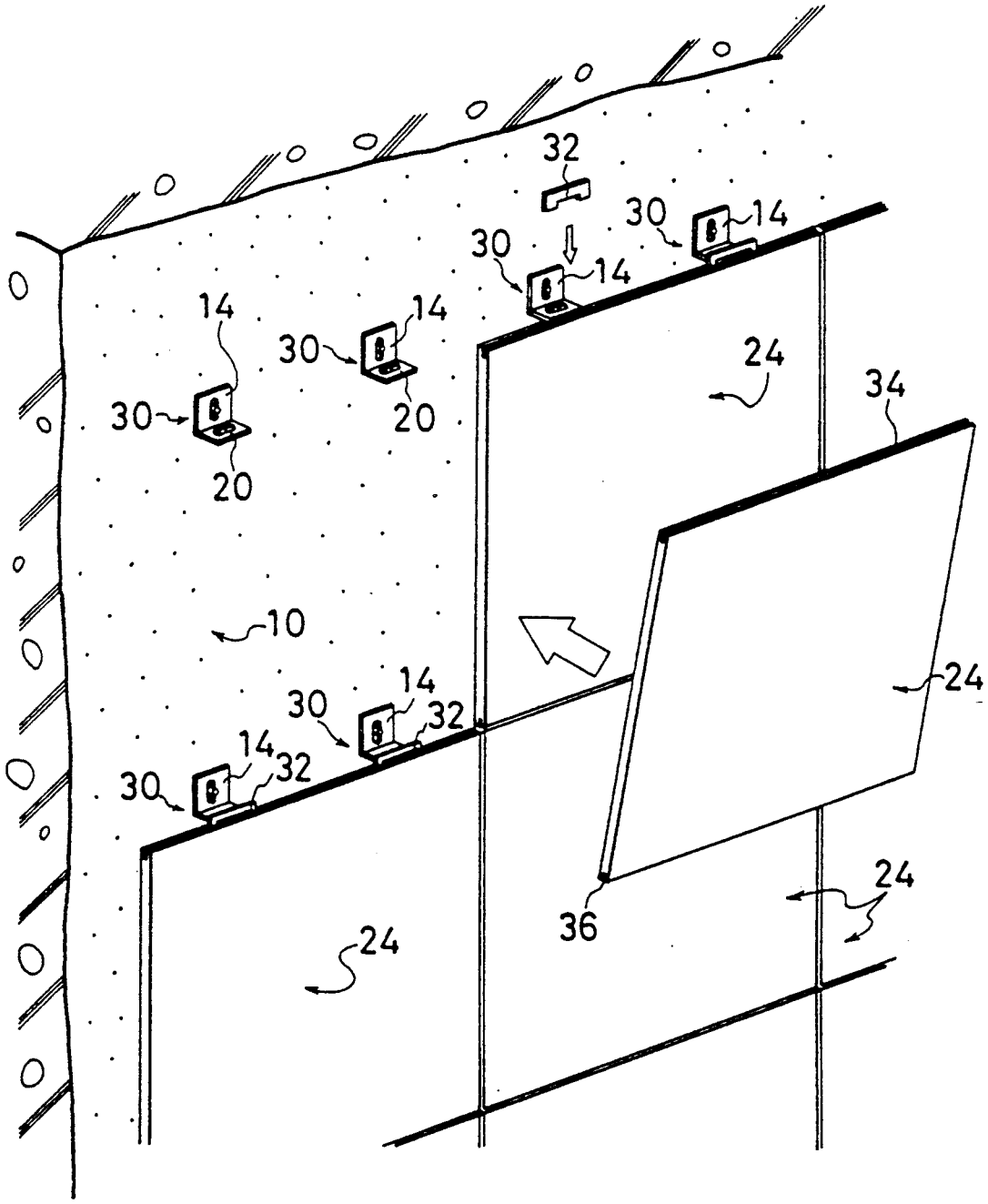
FIG. 1 is a general perspective view showing a first embodiment of a construction method according to the present invention.
Figure 2:
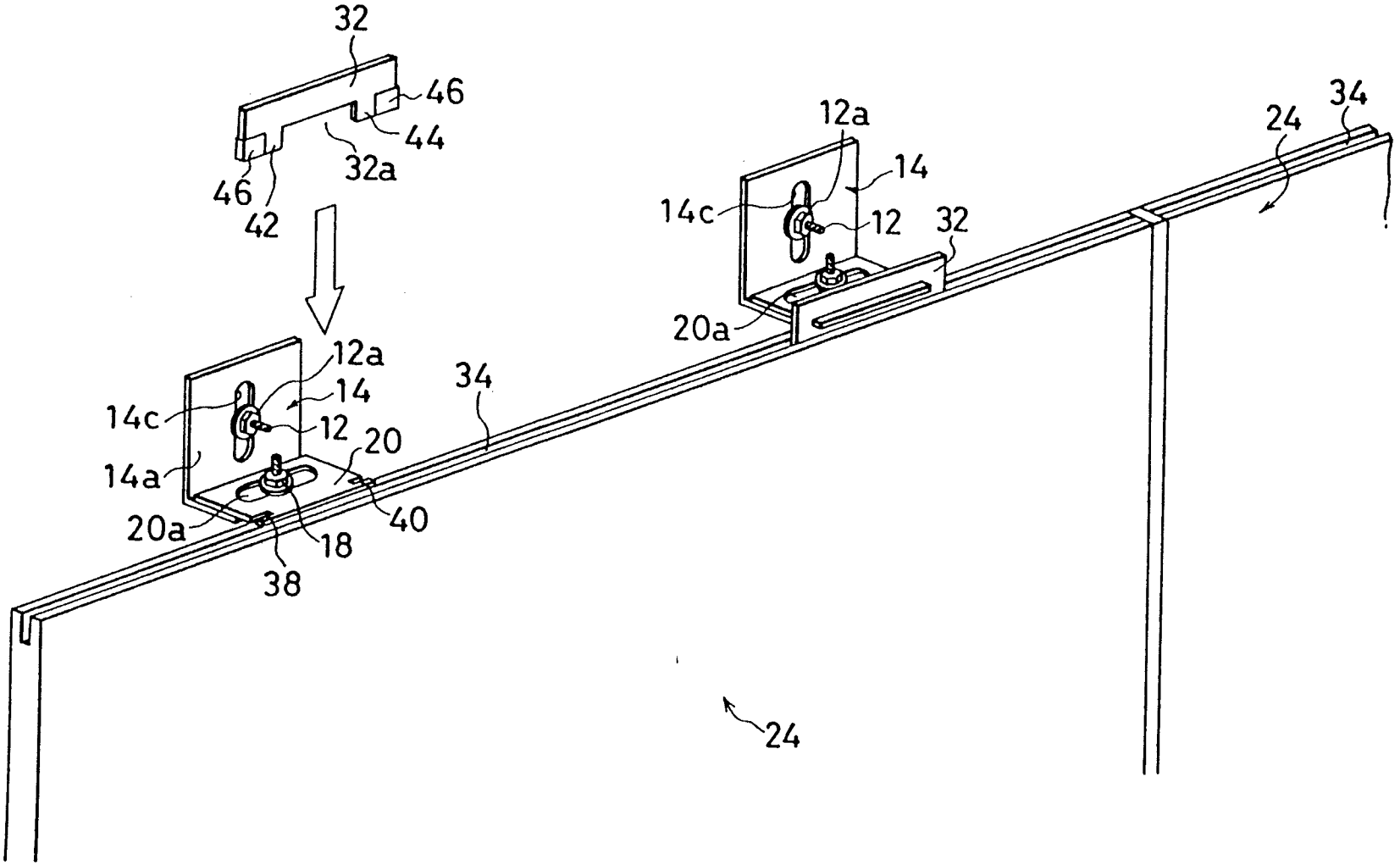
FIG. 2 is a fragmentary perspective view corresponding to FIG. 1.
Figure 3:
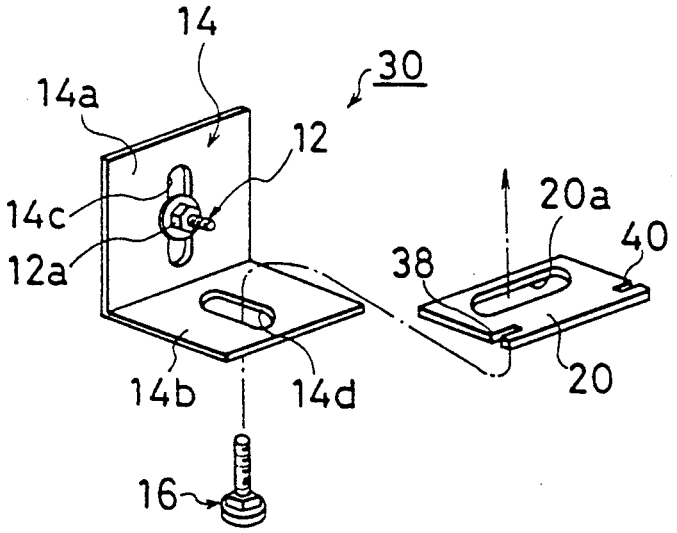
FIG. 3 is a perspective view showing fixtures used in the first embodiment.

FIG. 1 is a general perspective view showing a first embodiment of a construction method according to the present invention, FIG. 2 is a fragmentary enlarged view corresponding to FIG. 1, and FIG. 3 is a perspective view showing fixtures used in the first embodiment.

In this embodiment, a plurality of boardlike building elements 24 are fixed to a building body 10 by the use of first fixtures 30 and second fixtures 32. The boardlike building element 24 has grooves 34 and 36 formed in the upper and lower edge faces thereof in the lengthwise direction thereof over the whole width, the lower edge of the second fixture 32 is fitted in the upper edge groove 34, and the upper edge of the second fixture 32 is fitted in the lower edge groove 36.

As shown in FIG. 3, the first fixture 30 is composed of an L-shaped fixture 14 and a straight fixture 20. The L-shaped fixture 14 has a vertical segment **14*a* and a horizontal segment 14*b*, the vertical segment 14*a* is formed with a slot 14*c*, an anchor bolt 12 is inserted in the slot 14*c*, and a nut 12*a* is tightened to fix the L-shaped fixture to the building body 10. The horizontal segment 14*b* is formed with a slot 14*d* extending perpendicularly to the wall surface of the building body 10. The straight fixture 20 is formed with a slot 20*a* extending perpendicularly to the direction of elongation of the slot 14*d*, a square-necked bolt 16 is inserted in the slots 14*d* and 20*a* in the upward direction, and a nut 18 is tightened to the square-necked bolt 16, whereby the straight fixture 20 is fixed to the L-shaped fixture 14**.

A distal edge portion of the straight fixture 20 (which is remote from the building body 10) is formed with a pair of slits 38 and 40 extending from either side edge. The second fixture 32 is coupled to the slits 38 and 40 in the downward direction. The second fixture 32 has a cutout **32*a* formed in a lower central portion thereof, and leg segments 42 and 44 extending downward from both side edges. A spacer 46 made of synthetic resin is attached to each leg segment 42, 44**.

Specifically, the second fixture 32 is made wider than the straight fixture 20 so that an outer edge portion of each leg segment 42, 44 projects a little from the corresponding slit 38, 40 of the straight fixture 20. The projecting portion is covered with the spacer 46.

The construction process of securing the boardlike building elements 24 is performed as follows. First, as shown in FIG. 1, fix a number of L-shaped fixtures 14 to the building body 10, and fix the straight fixtures 20 to the L-shaped fixtures 14. Then, position the lower edge groove 36 of a boardlike building element 24 to a second fixture 32 fixed to the building body 10, and position the upper groove 34 of the boardlike building element 24 under the slits 38 and 40 of a straight fixture 20. While holding the boardlike building element 24 by hands, insert a second fixture 32 in the slits 38 and 40 in the downward direction such that the leg segments 42 and 44 are inserted together with the spacers 46 in the upper edge groove 34. As a result, the boardlike building element 24 is secured to the building body 10.

As described above, according to this embodiment, the boardlike building element 24 can very readily be fixed to the building body 10. Since the groove 34 is formed in the upper edge face of the boardlike building element 24, the second fixture 32 can readily be inserted in the upper edge groove 34 by aligning the upper edge of the boardlike building element 24 (by positioning the groove 34 directly under the slits 38 and 40).

In this embodiment, since the groove 36 is formed in the lower edge face of the boardlike building element 24, even after the second fixture is fitted in the groove 34 in the downward direction, the position of the boardlike building element 24 can be fine-adjusted by slightly sliding the boardlike building element 24 horizontally and laterally in relation to the building body 10.

Further, since the L-shaped fixture 14 and the straight fixture 20 have the respective slots **14*d* and 20*a* which orthogonally cross each other, by adjusting the straight fixture 20, the slits 38 and 40 can be accurately positioned at a predetermined distance away from the wall surface of the building body 10, and the surfaces of all the boardlike building elements 24** can be made flush.

Further, in this embodiment, since the leg segments 42 and 44 are inserted in the groove 34, the contact area between the second fixture 32 and the boardlike building element 24 is wide; thus, an external force applied to the boardlike building element 24 in a direction perpendicular thereto is widely distributed to the entire area of the leg segments 42 and 44. Therefore, even if a large external force is applied, the clamped portion of the boardlike building element 24 is not broken, with the result that the support of the building elements is very stable.

Further, in this embodiment, since the spacers 46 are attached to the leg segments 42 and 44, the leg segments 42 and 44 are closely fitted in the groove 34 without looseness; therefore, the boardlike building element 24 involves no looseness, and can be rigidly kept in place.

Other embodiments of the present invention will be described with reference to FIGS. 4, 5 and 6. In these drawings, components identical with those shown in FIGS. 1 through 3 are designated by the same reference numerals.

Figure 4:
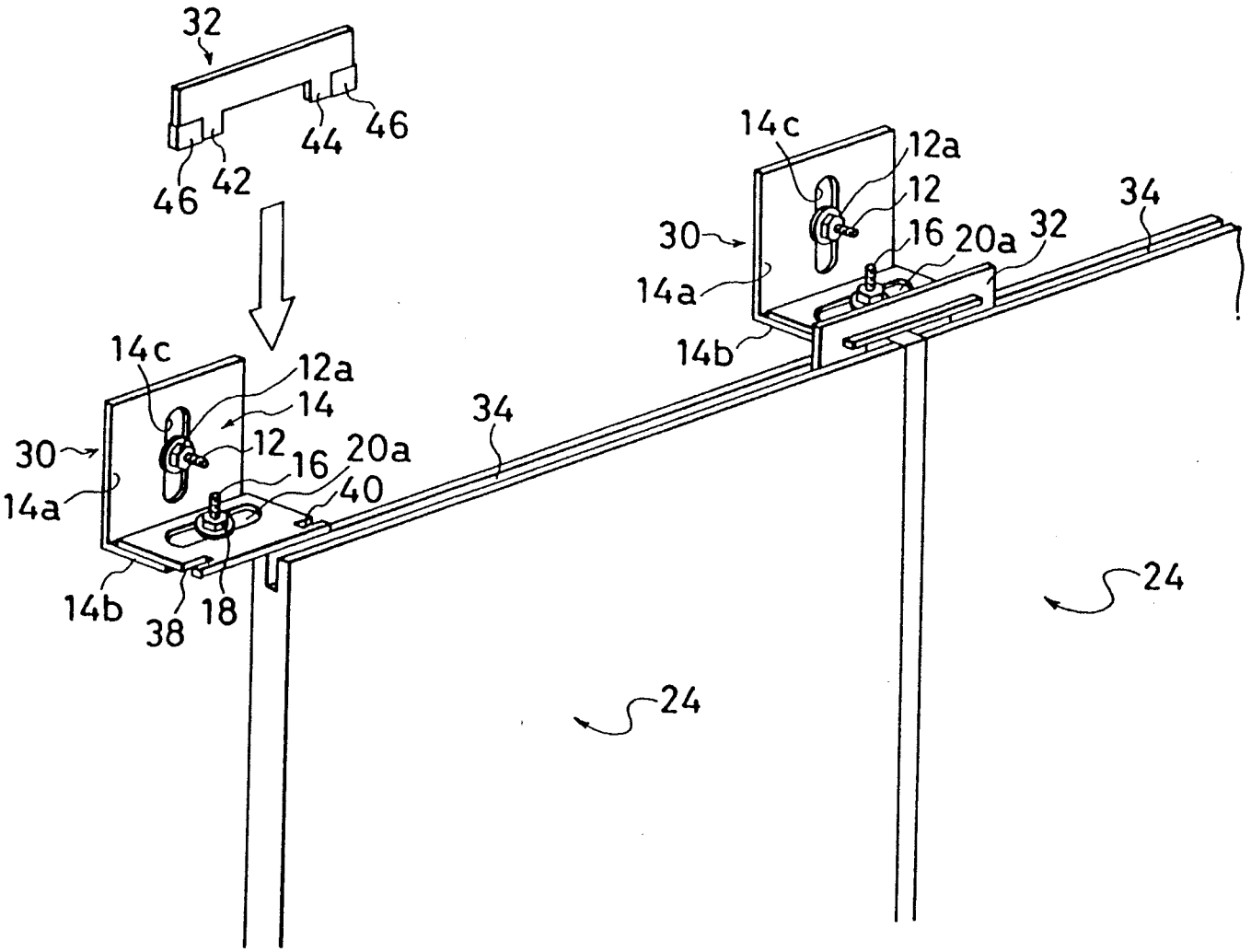
FIG. 4 is a fragmentary perspective view showing a second embodiment of the present invention.

FIG. 4 is a perspective view showing a second embodiment of the present invention. In this embodiment, one second fixture 32 is disposed so as to extend over two adjacent boardlike building elements 24. Therefore, as compared to the first embodiment shown in FIGS. 1 through 3, this second embodiment reduces the number of (first and second) fixtures to half.

Figure 5:
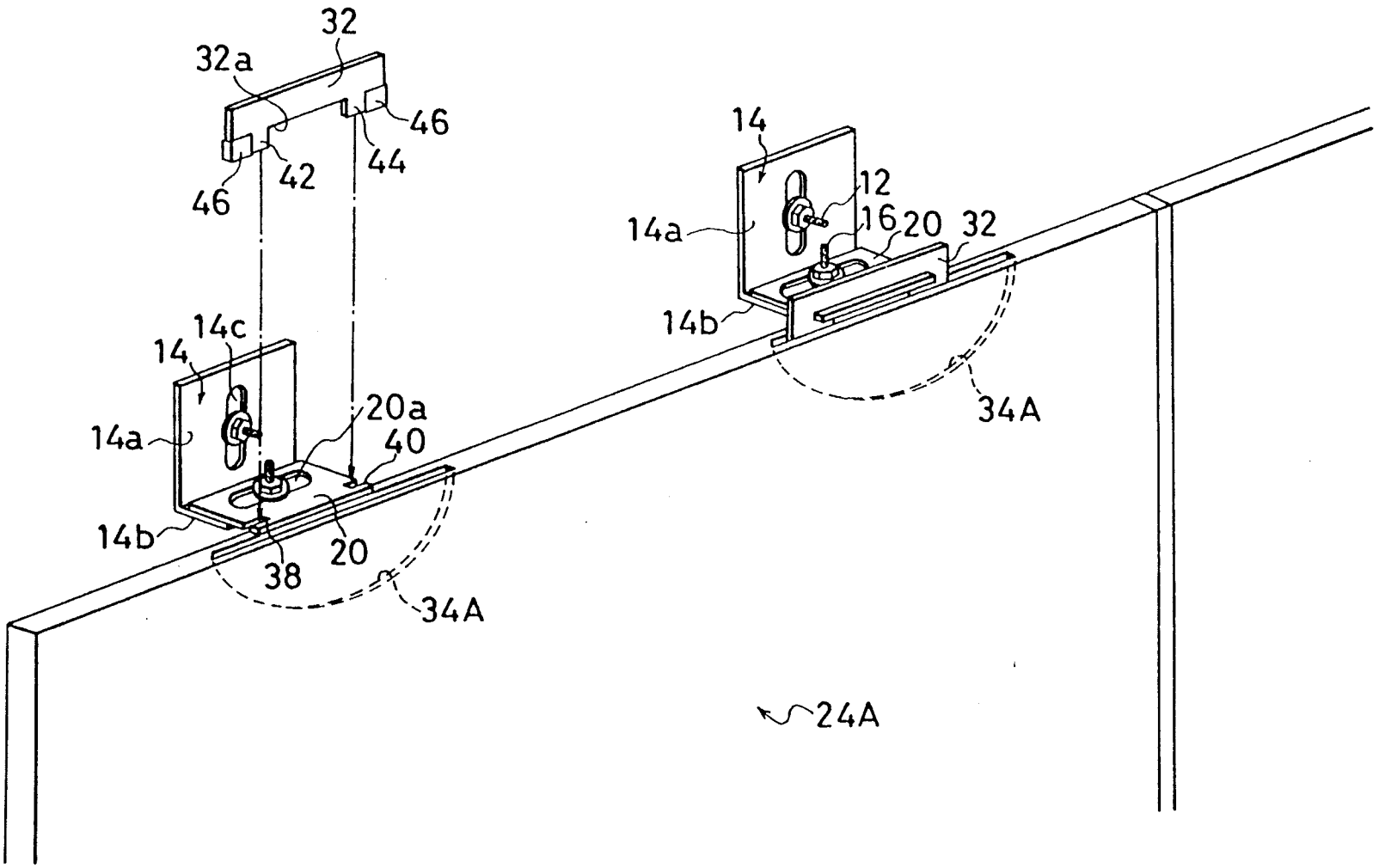
FIG. 5 is a fragmentary perspective view showing a third embodiment of the present invention.

FIG. 5 is a perspective view showing a third embodiment of the present invention. In this embodiment, the upper edge face of the boardlike building element 24A is formed with partial grooves 34A. Although the illustrated groove is in the form of a semi-circle, groove 34A can readily be formed by the use of a cutter of the rotary disc type.

Figure 6:
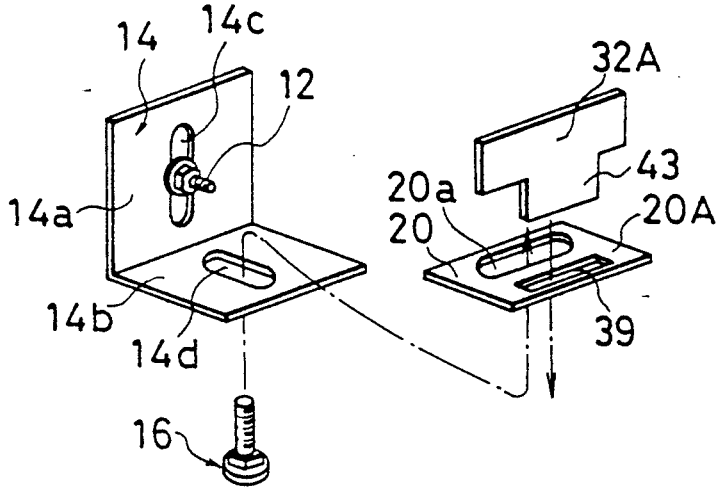
FIG. 6 is a perspective view showing fixtures used in a fourth embodiment of the present invention.
Figure 7:
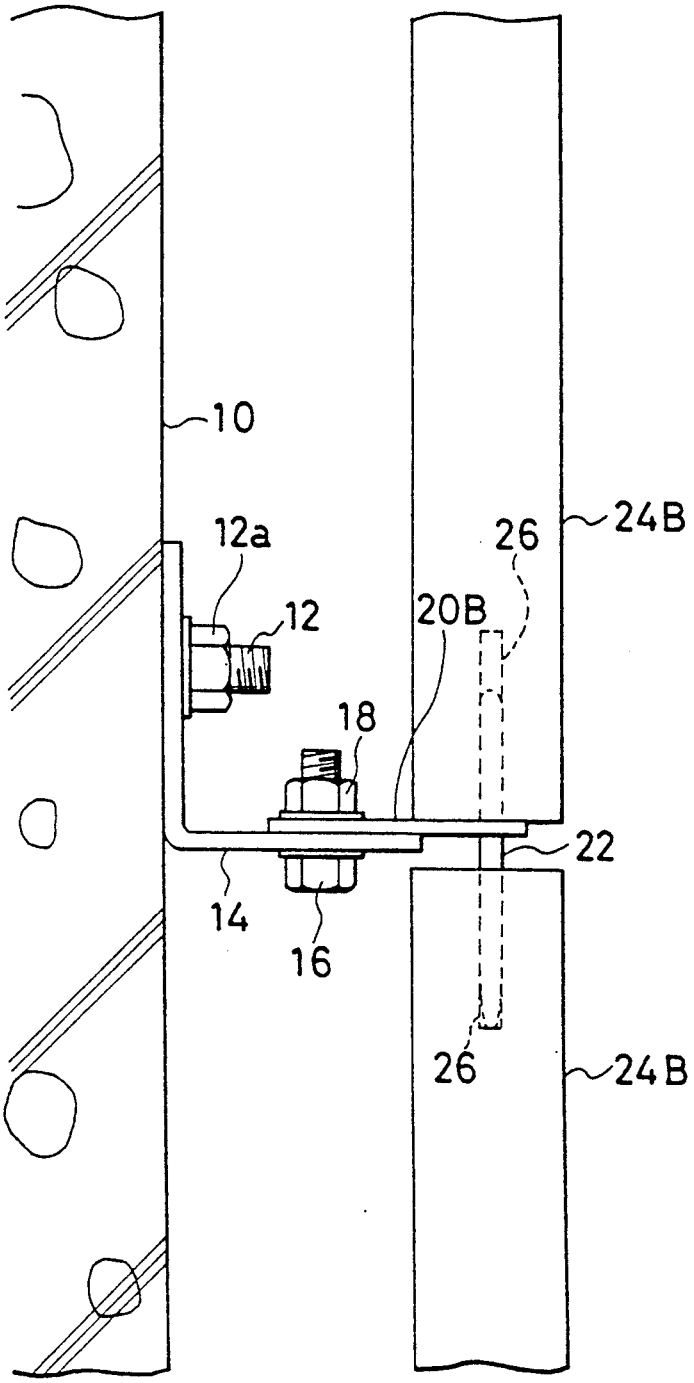
FIG. 7 PRIOR ART
FIG. 7 is a sectional view showing a conventional construction method.

FIG. 6 is a perspective view showing fixtures used in a fourth embodiment of the present invention. In this embodiment, a second fixture 32A has one leg segment 43 which is inserted in a slit 39 formed in a straight fixture 20A.

Figure 8:
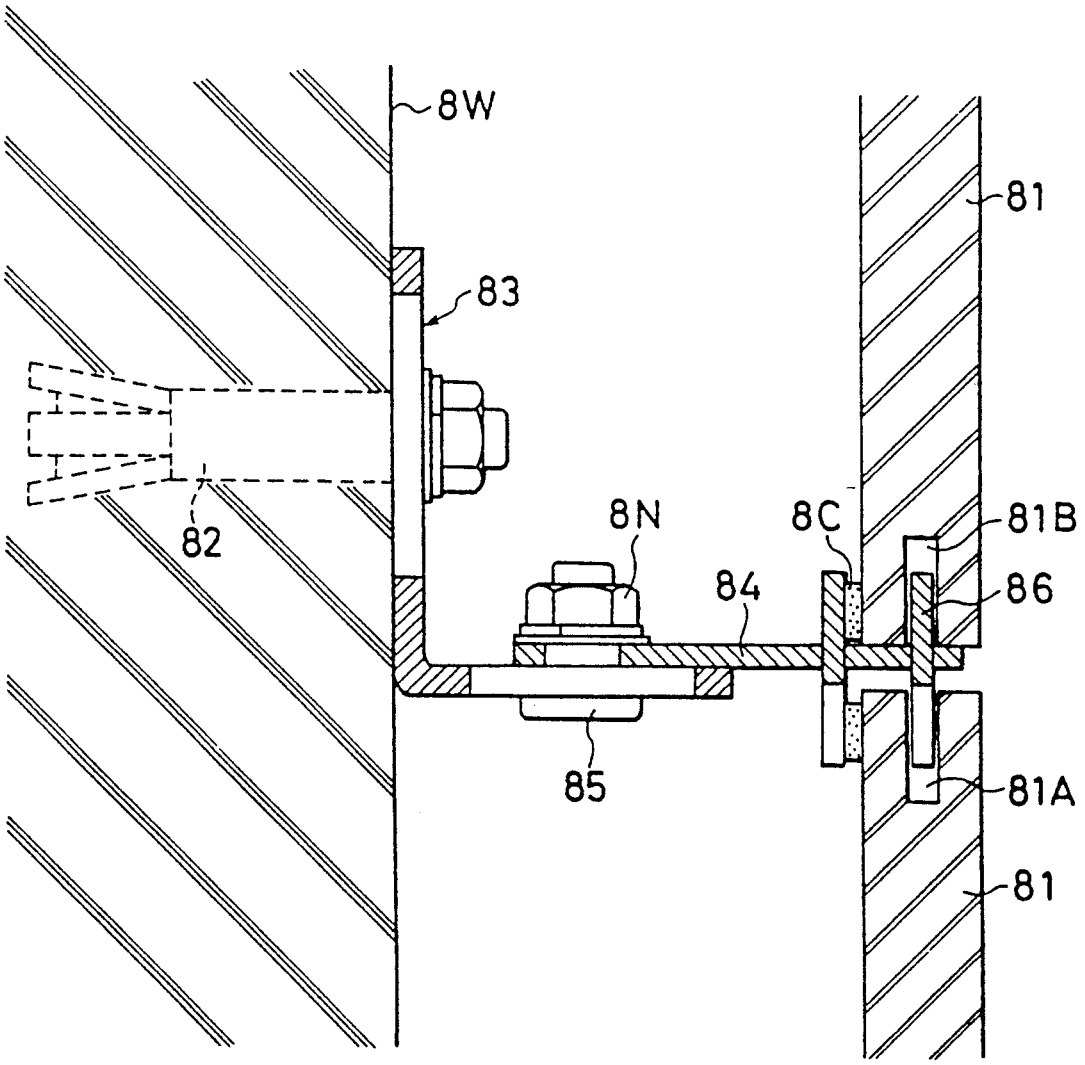
FIG. 8 is a sectional view showing a fifth embodiment of the present invention.

A fifth embodiment of the present invention will be described with reference to FIGS. 8 through 10. FIG. 8 is a sectional view showing this fifth embodiment, FIG. 9 is a perspective view showing an L-shaped fixture, a straight fixture, and others, and FIG. 10 is a perspective view showing the process of attaching first and second insert plates.

A boardlike building element 81 is a large-size tile board, a stone board, or the like, which has a groove 81A formed in the upper edge face thereof in the lengthwise direction thereof. The boardlike building element 81 additionally has a lower edge groove 81B formed in the lower edge face thereof.

To arrange and fix the boardlike building elements 81 to a wall surface 8W (of a building body), it is required to attach an anchor bolt 82 at a predetermined position, and fix the L-shaped fixture 83 to the wall surface 8W by means of the anchor bolt 82.

Figure 9:
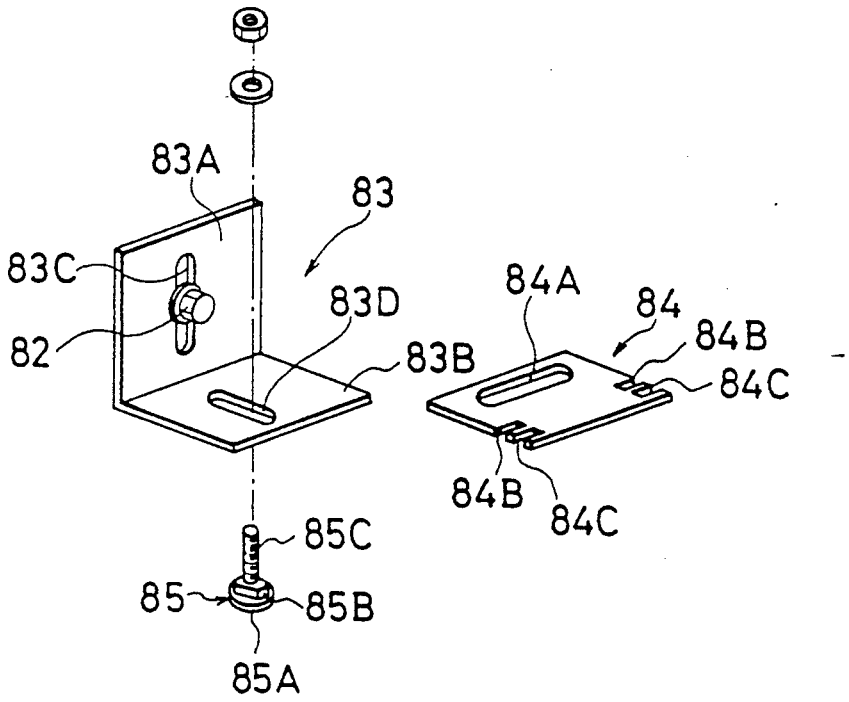
FIG. 9 is a perspective view showing an L-shaped fixture, a straight fixture, and others used in the fifth embodiment.
Figure 10:
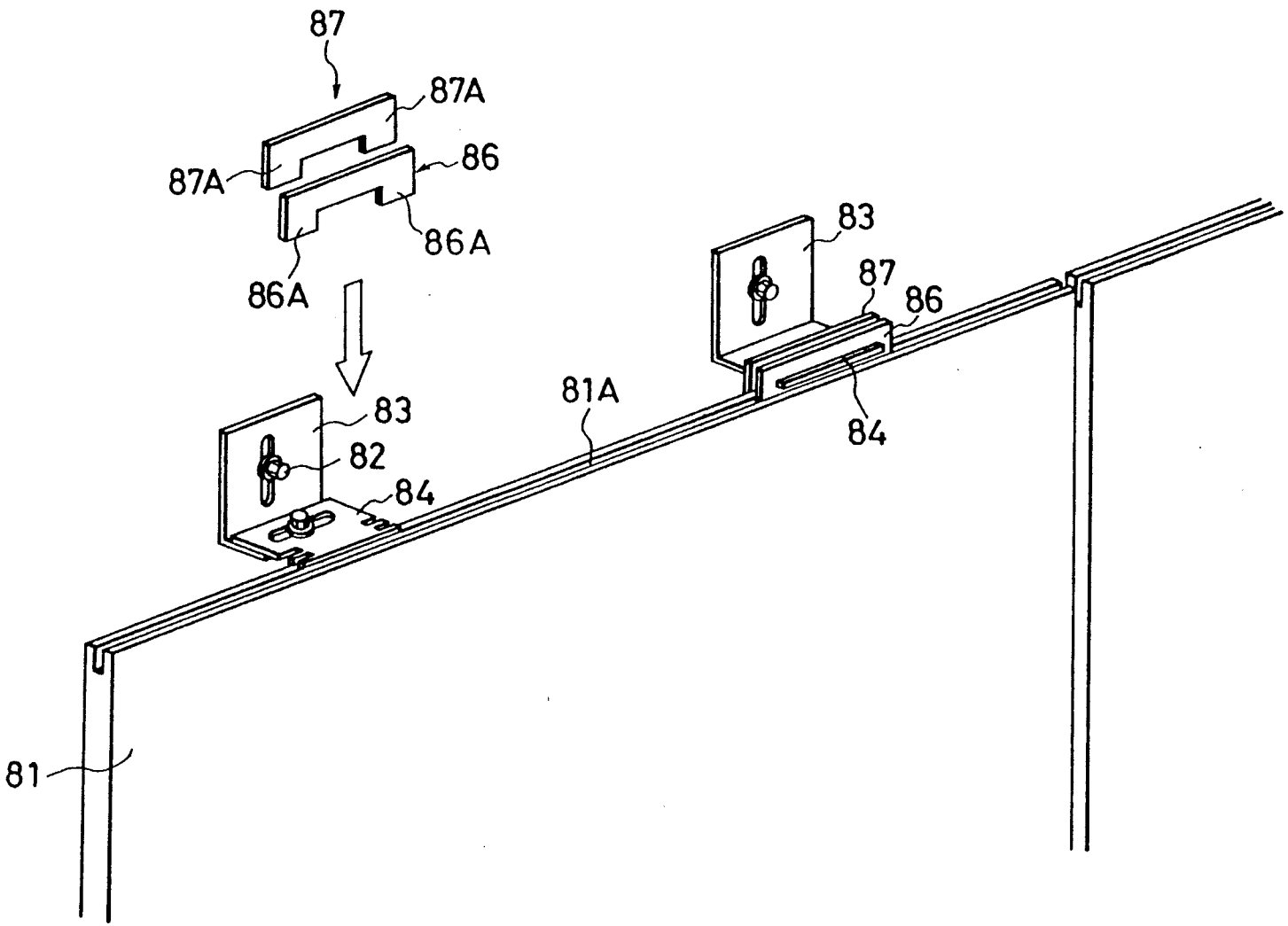
FIG. 10 is a perspective view showing the process of fixing boardlike building elements by the use of insert plates in the fifth embodiment.

As shown in FIG. 9, the L-shaped fixture 83 is made in the form of a character L so as to have a vertical segment 83A and a horizontal segment 83B. The vertical segment 83A has a slot 83C formed in a central portion thereof which extends in the vertical direction, and the horizontal segment 83B has a slot 83D extending perpendicularly to the vertical segment 83A. The anchor bolt 82 is inserted in the slot 83C so that the L-shaped fixture 83 can be fixed to the wall surface 8W at a proper height. A straight fixture 84 is superposed on the horizontal segment 83B. This straight fixture 84 has a slot 84A formed therein which extends perpendicularly to the slot 83D, and first and second pairs of slits 84C and 84B formed in a distal edge portion thereof which are parallel to each other and extend from both side edges.

To couple the straight fixture 84 to the horizontal segment 83B, it is required to align the slot 84A of the straight fixture 84 with the slot 83D of the horizontal segment 83B of the L-shaped fixture 83, fit a square portion 85B of a square-necked bolt 85 in the slot 83D, to project upwardly and tighten a nut 8N over a threaded portion 85C. The length of horizontal projection of the straight fixture 84 can be adjusted by means of the slot 83D. The lateral position of the straight fixture 84 can be adjusted by means of the slot 84A.

When used, in the condition shown in FIG. 10, it is required to insert first and second insert plates 86 and 87 in the first and second slits 84C and 84B, respectively, in the downward direction. Specifically, the first and second insert plates 86 and 87 have leg segments 86A and 87A, respectively, extending downward from the lower lateral edge; and, the leg segments 86A and 87A are inserted in the slits 84C and 84B, respectively. Subsequently, the lower edge or leg segments of the first insert plate 86 having passed through the first slits 84C is inserted in the upper edge groove 81A of the boardlike building element 81 arranged on the lower side of the straight fixture 84, and the upper edge of the first insert plate 86 is fitted in the lower edge groove 81B of another boardlike building element 81 by arranging it on the upper side of the straight fixture 84. Consequently, the two boardlike building elements 81 are vertically arranged supported together by the upper and lower edges of the first insert plate 86. As a result, the boardlike building elements 81 are secured with a predetermined distance are from the wall surface 8W. Additionally, the second insert plate 87 is inserted in the second slits 84B and disposed on the back side of the boardlike building elements 81. By filling the space between the second insert plate 87 and the boardlike building elements 81 with a silicone material 8C such that the back face of the boardlike building element 81 and the front face of the second insert plate 87 are rigidly bonded together with the silicone material 8C, the building element 81 is prevented from shifting, even if a pushing force of wind, impact, etc. is applied to the front side of the boardlike building element 81. Such a pushing force is transferred to the second insert plate 87 without causing any stress to be imposed on the upper and lower edge grooves 81A and 81B in concentrated form; therefore, the boardlike building element is prevented from being broken. Also the boardlike building element is prevented from shifting toward the wall surface 8W by the second insert plate 87, and thus, the boardlike building elements are rigidly and stably secured in place.

When the L-shaped fixture 83 and the straight fixture 84 are coupled together before starting the construction process, the only work to be done is to insert the insert plates 86 and 87 in the slits 84B and 84C of the straight fixture 84 in the downward direction. Since the grooves 81A and 81B are formed in the upper and lower edge faces, in the lengthwise direction thereof, of the boardlike building element 81, it is not necessary to define the lateral position of the L-shaped fixture 83 with high preciseness. That is, the first insert plate 86 may be inserted in the grooves 81A and 81B at an approximate position to fix the boardlike building elements 81, thereby facilitating the construction process.

Therefore, in this embodiment, the boardlike building element can readily be secured by inserting the first and second insert plates in the slits of the straight fixture in the downward direction, whereby the pushing force of wind, impact, etc. applied to the front face of the boardlike building element can be borne by the second insert plate, and thus, a satisfactory strength of installation can be ensured.

What is claimed is:

1. A construction method of fixing boardlike building elements to a wall surface of a building body in arranged form by fixtures, each boardlike building element having upper and lower edge grooves formed in upper and lower edge faces thereof in a lengthwise direction thereof; and each fixture being composed of an L-shaped fixture to be fixed to the wall surface, a straight fixture to be coupled to the L-shaped fixture so as to project horizontally therefrom which has first and second slits formed in a distal edge portion thereof and extending parallel to the wall surface, and first and second insert plates to be inserted in the first and second slits, respectively, of the straight fixture in a downward direction; comprising the steps of:

inserting a first insert plate in a first slit of a straight fixture after the straight fixture is coupled to an L-shaped fixture, fitting a lower edge portion of said first insert plate in an upper edge groove of a first boardlike building element arranged under a lower side of said straight fixture, fitting an upper edge portion of said first insert plate in a lower edge groove of a second boardlike building element arranged on an upper side, of said straight fixture so that said first and second boardlike building elements are vertically arranged and fixed to the wall surface, and inserting a second insert plate in a second slit of said straight fixture which is provided closer to the wall surface than said first slit so that said first and second boardlike building elements are prevented from shifting toward the wall surface.

2. A construction method according to claim 1, wherein the L-shaped fixture has a vertical segment to be fixed to the building body and a horizonal segment extending horizontally from the vertical segment, to which said straight fixture is secured by a bolt; and the horizontal segment and the straight fixture include individual slots which extend so as to cross each other and in which the bolt is inserted.

3. A construction method according to claim 1, wherein the upper edge groove of the boardlike building element extends over the whole width of the boardlike building element.

4. A construction method according to claim 1, wherein the lower edge groove of the boardlike building element extends over the whole width of the boardlike building element.

5. A construction method according to claim 1, wherein the groove is semi-circular in side view.

6. A construction method according to claim 1, wherein the lower edge groove of the boardlike building element is semi-circular in side view.

7. A construction method according to claim 1, wherein said first insert plate is loosely fitted into said lower and upper edge grooves of said first and second boardlike building elements.

8. A construction method according to claim 1 further comprising the step of filling a space between said second insert plate and said first and second boardlike boardlike building elements with a synthetic resin.

9. A construction method of fixing boardlike building elements to a wall surface of a building body with fixtures, each boardlike building element having upper and lower grooves extending lengthwise on upper and lower edge faces thereof; and each fixture being composed of an L-shaped fixture having a vertical section to be fixed to the wall surface and a horizontal section extending outwardly from the wall surface and having a first slot, a straight fixture coupled to the horizontal section and having a second slot and first and second pairs of slits extending inwardly from opposite side edges to be parallel to the vertical section, and first and second insert plates, each having a pair of leg segments extending downwardly from opposite sides to be inserted in the first and second pairs of slits, respectively, said construction method comprising the step of:

fixing the vertical sections of the L-shaped fixtures to the building body so that the horizontal sections extend from the wall surface, superposing the straight fixtures on the respective horizontal sections of the L-shaped fixtures and connecting the straight fixtures and the fixtures together;

inserting leg segments of first and second insert plates into first and second pairs of slits of a first straight fixture;

fitting a lower edge groove of a boardlike building element over an upper edge of said first insert plate such that an upper edge groove of said boardlike building element aligns with a first pair of slits of a second straight fixture which has been arranged above said first straight fixture;

inserting leg segments of another first insert plate into said first pair of slits of said second straight fixture such that said leg segments of said another first insert plate fit into said upper groove of said boardlike building element to thereby fix said boardlike building element to the wall surface; and inserting leg segments of another second insert plate into a second pair of slits of said second straight fixture which has been provided behind said first pair of slits to thereby prevent said boardlike building element from shifting toward the wall surface beyond a position of said second pair of slits.

10. A construction method according to claim 9, wherein said first insert plates are loosely fitted into said lower and upper edge grooves of said boardlike building element.

11. A construction method according to claim 10 further comprising the step of filling a space between said second insert plate and said boardlike building element with a synthetic resin to rigidly bond said boardlike building element to said second insert plate, thereby securing said boardlike building element to the wall surface.

12. A construction method according to claim 9, wherein said first and second slots extend perpendicular to each other, thereby permitting two-dimensional fine adjustment of said boardlike building element with respect to the wall surface.

* * * * *